US010869535B2

(12) United States Patent
Lee

(10) Patent No.: US 10,869,535 B2
(45) Date of Patent: Dec. 22, 2020

(54) AIRTIGHT LIP COSMETIC CASE HAVING IMPROVED SEALING CAPABILITY

(71) Applicants: PUM-TECH KOREA CO., LTD, Incheon (KR); CTK CO., LTD, Seongnam-si (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 16/334,331

(22) PCT Filed: Sep. 19, 2017

(86) PCT No.: PCT/KR2017/010270
§ 371 (c)(1),
(2) Date: Mar. 18, 2019

(87) PCT Pub. No.: WO2018/056678
PCT Pub. Date: Mar. 29, 2018

(65) Prior Publication Data

US 2019/0200727 A1 Jul. 4, 2019

(30) Foreign Application Priority Data

Sep. 22, 2016 (KR) ..... 10-2016-0121223

(51) Int. Cl.
*B65D 83/00* (2006.01)
*B65D 41/62* (2006.01)
(Continued)

(52) U.S. Cl.
CPC ..... *A45D 40/06* (2013.01); *A45D 40/04* (2013.01); *B65D 41/62* (2013.01); *A45D 40/02* (2013.01);
(Continued)

(58) Field of Classification Search
CPC ..... A45D 40/06; A45D 40/00; A45D 40/04; A45D 2200/051; A45D 2200/055;
(Continued)

(56) References Cited

U.S. PATENT DOCUMENTS 4,603,989 A * 8/1986 Ackerman ..... A45D 40/06 401/74
5,533,823 A * 7/1996 Pierpont ..... A45C 13/008 215/342
(Continued)

FOREIGN PATENT DOCUMENTS

JP 2000-004932 A 1/2000
JP 2000-060637 A 2/2000
(Continued)

*Primary Examiner* — David J Walczak
(74) *Attorney, Agent, or Firm* — Heedong Chae; Lucem, PC

(57) ABSTRACT

An airtight lip cosmetic case having improved sealing capability includes a lower case; a lead shaft which rises inside the lower case by means of a screw rotation; a rising piston which is coupled to the top of the lead shaft and rises together with the lead shaft, and which has a lip cosmetic product attached to the upper side thereof; an upper case which is coupled to the top of the lower case; and an over-cap which is coupled to the lower case so as to open and close the upper case, wherein the over-cap is separately formed of an inner over-cap and an outer over-cap, and the inner over-cap has an elastic groove formed on the lower outer circumference thereof such that the lower inner circumference of the inner over-cap is elastically inserted into the outer circumference of the upper case.

7 Claims, 8 Drawing Sheets

(51) Int. Cl.

| | |
|---|---|
| ***A45D 40/04*** | (2006.01) |
| ***A45D 40/02*** | (2006.01) |
| ***A45D 40/06*** | (2006.01) |
| *A45D 40/00* | (2006.01) |

(52) U.S. Cl.
CPC ..... *A45D 2040/0025* (2013.01); *A45D 2200/051* (2013.01); *B65D 83/0005* (2013.01); *B65D 83/0027* (2013.01)

(58) Field of Classification Search
CPC .... A45D 2040/0025; A45D 2040/0018; A45D 40/20; A45D 40/02; A45D 2040/20; A45D 2040/205; B65D 83/00; B65D 41/62; B65D 53/02; B65D 83/0005; B65D 83/0027; B65D 83/0033
See application file for complete search history.

(56) References Cited

U.S. PATENT DOCUMENTS 5,984,554 A * 11/1999 Bouix ..... A45C 13/008 401/98
6,070,725 A * 6/2000 Ito ..... A45D 40/06 206/385

FOREIGN PATENT DOCUMENTS

| | | | |
|---|---|---|---|
| JP | 5325593 | B2 | 10/2013 |
| KR | 10-1592914 | B1 | 2/2016 |
| KR | 10-1903494 | B1 | 10/2018 |

* cited by examiner

AIRTIGHT LIP COSMETIC CASE HAVING IMPROVED SEALING CAPABILITY

CROSS-REFERENCE TO RELATED APPLICATIONS

This application is based on and claims the benefit of priority to Korean Patent Application No. 10-2016-0121223 filed on Sep. 22, 2016, with the Korean Intellectual Property Office, the disclosure of which is incorporated herein by reference.

TECHNICAL FIELD

The present invention relates to an airtight lip cosmetic case having improved sealing capability, the airtight lip cosmetic case including: a lower case; a lead shaft which rises inside the lower case by means of a screw rotation; a rising piston which is coupled to the top of the lead shaft and rises together with the lead shaft, and which has a lip cosmetic product attached to the upper side thereof; an upper case which is coupled to the top of the lower case so as to guide a vertical movement of the rising piston; and an over-cap which is coupled to the lower case so as to open and close the upper case, wherein the over-cap is separately formed of an inner over-cap and an outer over-cap, and the inner over-cap has an elastic groove formed on the lower outer circumference thereof such that the lower inner circumference of the inner over-cap is elastically inserted into the outer circumference of the upper case, and thus when the over-cap is coupled to the lower case, external air is prevented from entering inside the lip cosmetic case so as to prevent the lip cosmetic product from deteriorating or hardening by the external air.

BACKGROUND ART

Color cosmetics are used to beautifully adorn the skin of a user by making the appearance beautiful.

The Color cosmetics are classified into a base makeup used for making a skin color uniform and covering a defect and a point makeup used for partially enhancing a three-dimensional effect of lips, eyes, or nails. The base makeup includes a makeup base, a foundation and a powder, and the point makeup includes a lipstick, an eye liner, and a mascara.

Among various cosmetics needed for color makeup of a woman, the lipstick serves to protect lips and make the lips more stand out. The conventional lipstick is manufactured in the form of a stick formed of a cosmetic composition having various colors, and a lipstick cosmetic product protrudes or is inserted while ascending and descending inside the cosmetic case.

In other words, the conventional lipstick cosmetic case as described above includes a case for maintaining an appearance of the cosmetic case; a lipstick holder screwed inside the case, ascending and descending along a thread by a rotating operation of the case, and mounted thereon with a stick-type cosmetic product; a protection tube installed between the case and the lipstick holder and partially exposed to the outside to protect the cosmetic product while guiding a vertical movement of the lipstick holder; a fastening cap fastened to an upper portion of the case to securely fix the protection tube; and an over-cap for opening and closing the case.

However, according to the conventional lipstick cosmetic case, engagements between the over-cap and the case, between the case and the lipstick holder, and between the case and the protection tube are weak, thereby deteriorating sealing capability so that external air flows into the case during use, and thus the lipstick cosmetic product deteriorates or hardens due to the constant contact with the external air.

To solve the above mentioned problem, as shown in FIG. 1, Korean Patent Registration No. 10-1287094 discloses a structure of a lipstick case for protecting contents. The structure according to the above related art includes a lower case, a fixed member coupled in the lower case, a lipstick container coupled to the fixed member and accommodated therein with lipstick contents, and an outer cover, wherein a ring is formed on an outer circumference of the fixed member, and an inner cover is coupled to an inner circumference of the outer cover, so that a front end portion of the inner cover seals the inside of the lipstick while coming into contact with the ring.

However, since the related art has a structure that the end portion of the inner cover vertically comes into tight contact with a fitting groove of the ring to seal the contents of the lipstick, a gap is formed between the end portion of the inner cover and the ring and thus the inside of the lipstick is incompletely sealed when the lower case is incompletely fastened to the outer cover or the outer cover is slightly lifted during carrying the lipstick.

In addition, since the ring according to the related art is formed of silicone or a soft rubber material, the ring is deformed or hardened when used for a long time, and thus the end portion of the inner cover incompletely comes into tight contact with the ring, thereby deteriorating the sealing capability for the content of the lipstick.

DISCLOSURE

Technical Problem

To solve the above problems, the present invention provides an airtight lip cosmetic case having improved sealing capability, which includes: a lower case; a lead shaft which rises inside the lower case by means of a screw rotation; a rising piston which is coupled to the top of the lead shaft and rises together with the lead shaft, and which has a lip cosmetic product attached to the upper side thereof; an upper case which is coupled to the top of the lower case so as to guide a vertical movement of the rising piston; and an over-cap which is coupled to the lower case so as to open and close the upper case, wherein the over-cap is separately formed of an inner over-cap and an outer over-cap, and the inner over-cap has an elastic groove formed on the lower outer circumference thereof such that the lower inner circumference of the inner over-cap is elastically inserted into the outer circumference of the upper case, and thus when the over-cap is coupled to the lower case, external air is prevented from entering inside the lip cosmetic case so as to prevent the lip cosmetic product from deteriorating or hardening by the external air.

In addition, the present invention provides an airtight lip cosmetic case having improved sealing capability, in which the upper case is provided on an upper side thereof with an inner cap having an open upper end, wherein the inner cap is coupled while surrounding an upper portion of the upper case and pressed by the inner over-cap, so that the external air is prevented from flowing through an upper end of the upper case to prevent the lip cosmetic product from deteriorating or contaminating by the external air or foreign substances.

In addition, the present invention provides an airtight lip cosmetic case having improved sealing capability, in which a sealing shoulder is formed on a lower and outer circumference of the upper case, wherein the sealing shoulder extends downward from the outer circumference of the upper case while being spaced apart from the outer circumference of the upper case by a predetermined distance, and an upper outer portion of the sealing shoulder has a curved shape, so that the inner over-cap of the over-cap easily comes into tight contact with an outer circumference of the sealing shoulder to prevent the lip cosmetic product from deteriorating or hardening by the external air.

In addition, the present invention provides an airtight lip cosmetic case having improved sealing capability, in which the rising piston is provided on an outer side thereof with a sealing ring, such that the rising piston is operated to rise in a state in which the sealing ring comes into tight contact with an inner circumference of the upper case so as to prevent the lip cosmetic product from deteriorating or hardening after the external air introduced from a lower side of the rising piston comes into contact with the lip cosmetic product.

Technical Solution

The present invention provides an airtight lip cosmetic case having improved sealing capability and having a lip cosmetic product, in an upper case, rising and protruding when a lower case rotates, and the airtight lip cosmetic case includes:

the upper case rotatably coupled to an upper portion of the lower case;

a rising piston coupled inside the upper case to rise and having the lip cosmetic product attached to an upper side thereof; and an over-cap for opening and closing the upper case, wherein the over-cap includes an inner over-cap and an outer over-cap, and the inner over-cap is formed on a lower outer circumference thereof with an elastic groove such that the lower inner circumference of the inner over-cap is elastically inserted into an outer circumference of the upper case.

In addition, a sealing shoulder is formed on a lower outer circumference of the upper case, in which the sealing shoulder extends downward from the outer circumference of the upper case while being spaced apart from the outer circumference of the upper case by a predetermined distance.

In addition, an upper outer contour of the sealing shoulder is curved.

In addition, the upper case is provided on an upper side thereof with an inner cap, in which the inner cap is coupled while surrounding an upper portion of the upper case.

In addition, the rising piston is provided on an outer side thereof with a sealing ring, so that the rising piston is operated to rise in a state in which the sealing ring comes into tight contact with an inner circumference of the upper case.

In addition, a sealing protrusion wheel protruding from an inner circumference of the inner over-cap of the over-cap comes into tight contact with the outer circumference of the upper case.

In addition, an inner diameter of the sealing protrusion wheel of the inner over-cap may be smaller than an outer diameter of the sealing shoulder of the upper case.

Advantageous Effects

The airtight lip cosmetic case having improved sealing capability according to the present invention includes: a lower case; a lead shaft which rises inside the lower case by means of a screw rotation; a rising piston which is coupled to the top of the lead shaft and rises together with the lead shaft, and which has a lip cosmetic product attached to the upper side thereof; an upper case which is coupled to the top of the lower case so as to guide a vertical movement of the rising piston; and an over-cap which is coupled to the lower case so as to open and close the upper case, wherein the over-cap is separately formed of an inner over-cap and an outer over-cap, and the inner over-cap has an elastic groove formed on the lower outer circumference thereof such that the lower inner circumference of the inner over-cap is elastically inserted into the outer circumference of the upper case, and thus external air can be prevented from entering inside the lip cosmetic case when the over-cap is coupled to the lower case so as to prevent the lip cosmetic product from deteriorating or hardening by the external air.

In addition, according to the airtight lip cosmetic case having improved sealing capability of the present invention, the upper case is provided on an upper side thereof with an inner cap having an open upper end, in which the inner cap is coupled while surrounding an upper portion of the upper case and simultaneously pressed by the inner over-cap, so that the external air can be prevented from flowing through an upper end of the upper case to prevent the lip cosmetic product from deteriorating or contaminating by the external air or foreign substances.

In addition, according to the airtight lip cosmetic case having improved sealing capability of the present invention, a sealing shoulder is formed on a lower outer circumference of the upper case, in which the sealing shoulder extends downward from the outer circumference of the upper case while being spaced apart from the outer circumference of the upper case by a predetermined distance, and an upper outer contour of the sealing shoulder is curved, thus the inner over-cap of the over-cap easily comes into tight contact with an outer circumference of the sealing shoulder, so that the lip cosmetic product can be prevented from deteriorating or hardening by the external air.

In addition, according to the airtight lip cosmetic case having improved sealing capability of the present invention, the rising piston is provided on an outer side thereof with a sealing ring to allow the rising piston to be operated to rise in a state in which the sealing ring comes into tight contact with an inner circumference of the upper case, so that the lip cosmetic product can be prevented from deteriorating or hardening after the external air introduced from a lower side of the rising piston comes into contact with the lip cosmetic product.

BEST MODE

Mode for Invention

The technical objects implemented by the present invention will be apparent from the following preferred embodiments. Hereinafter, embodiments of the airtight lip cosmetic case having improved sealing capability according to the present invention will be described in detail with reference to the accompanying drawings.

Figure 1:
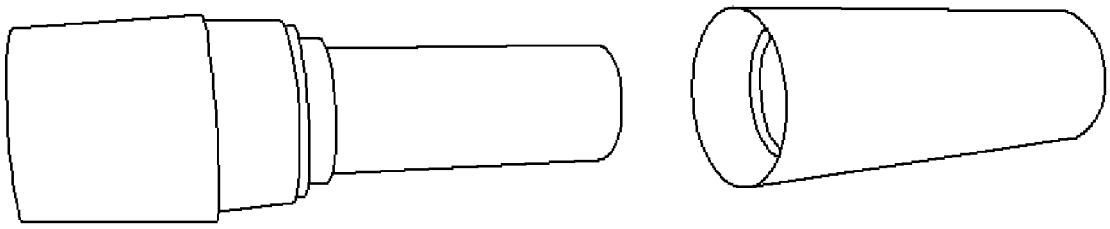
FIG. 1 is a view showing a structure for protecting contents of a conventional lipstick case.
Figure 2:
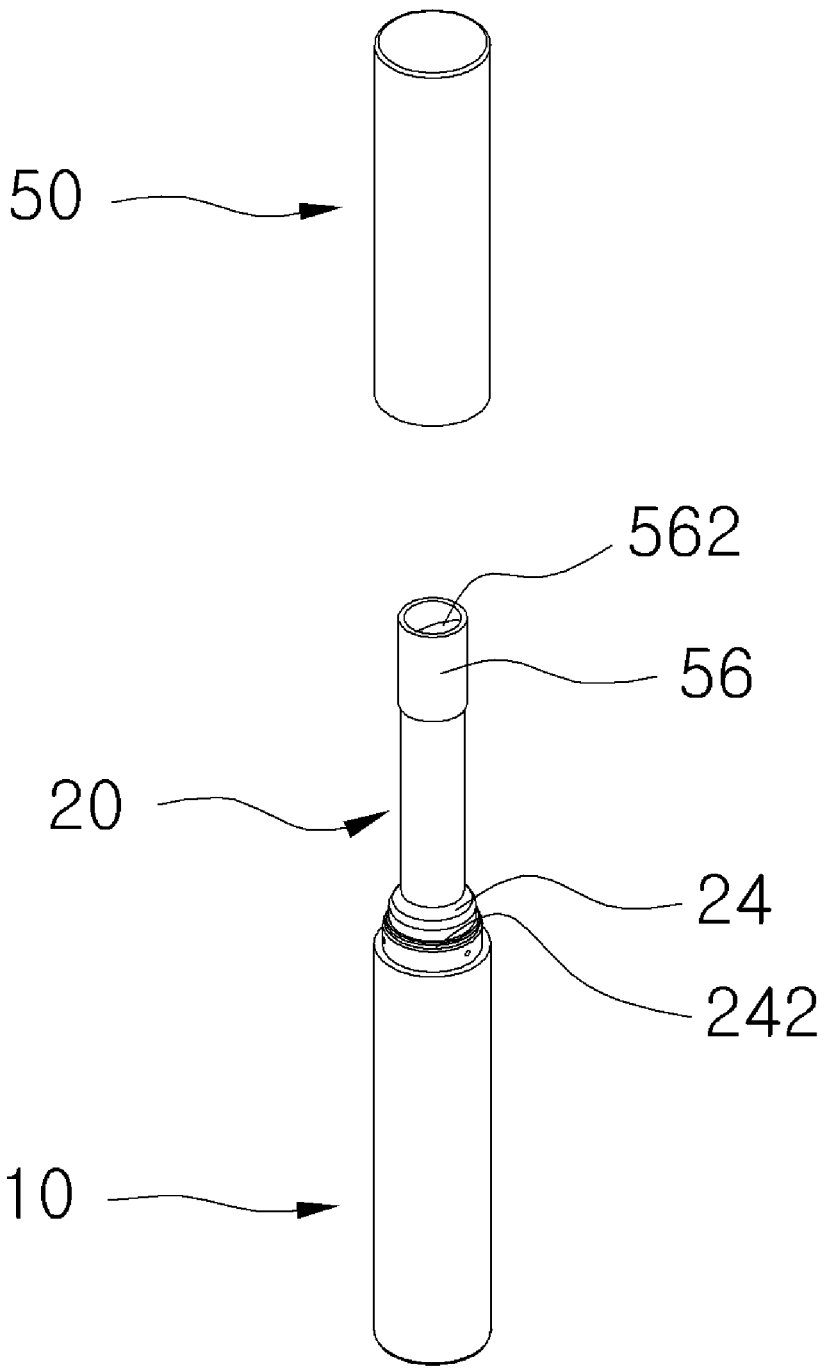
FIG. 2 is a perspective view of a lip cosmetic case according to an embodiment of the present invention.
Figure 3:
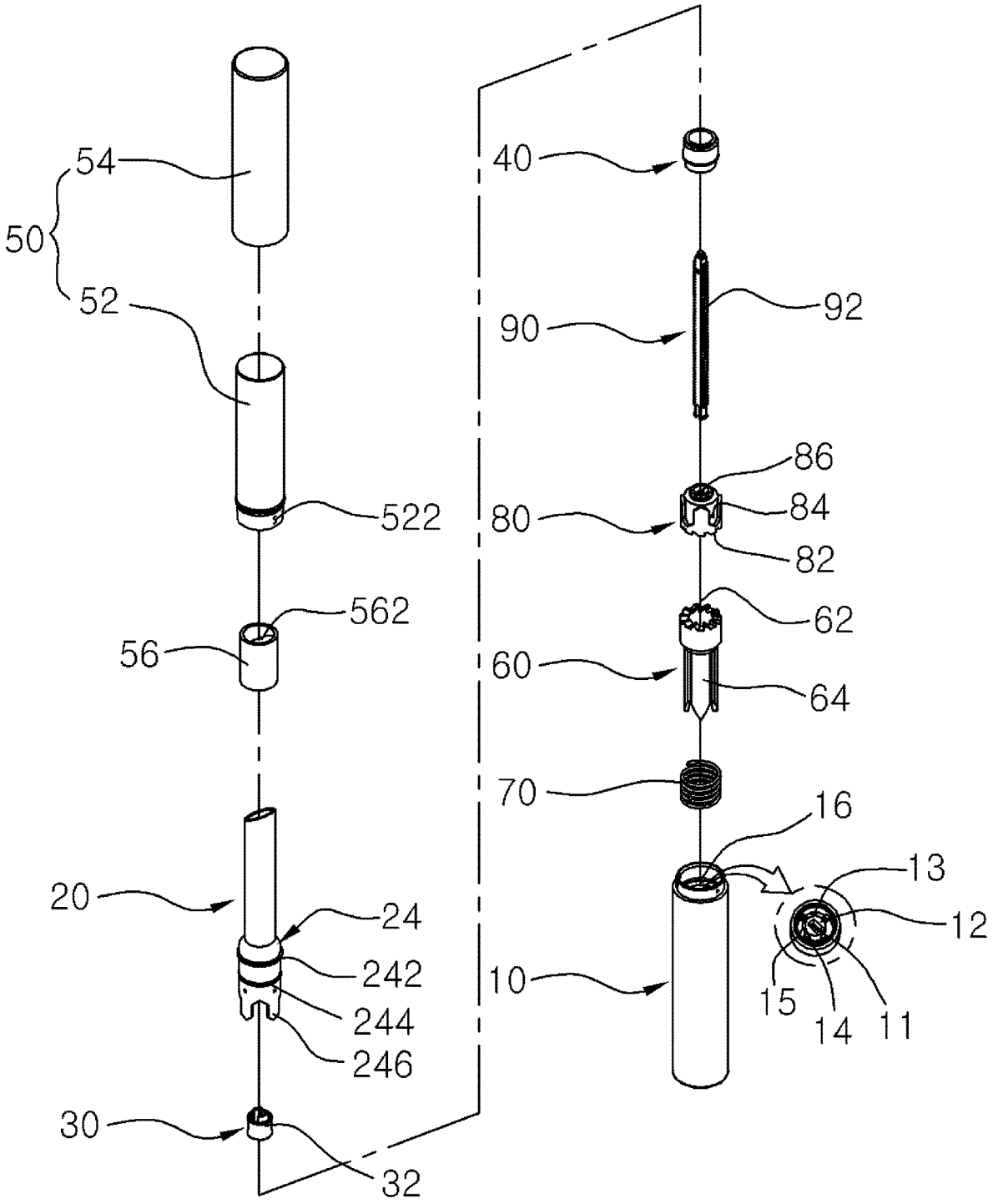
FIG. 3 is an exploded perspective view of a lip cosmetic case according to an embodiment of the present invention.
Figure 4:
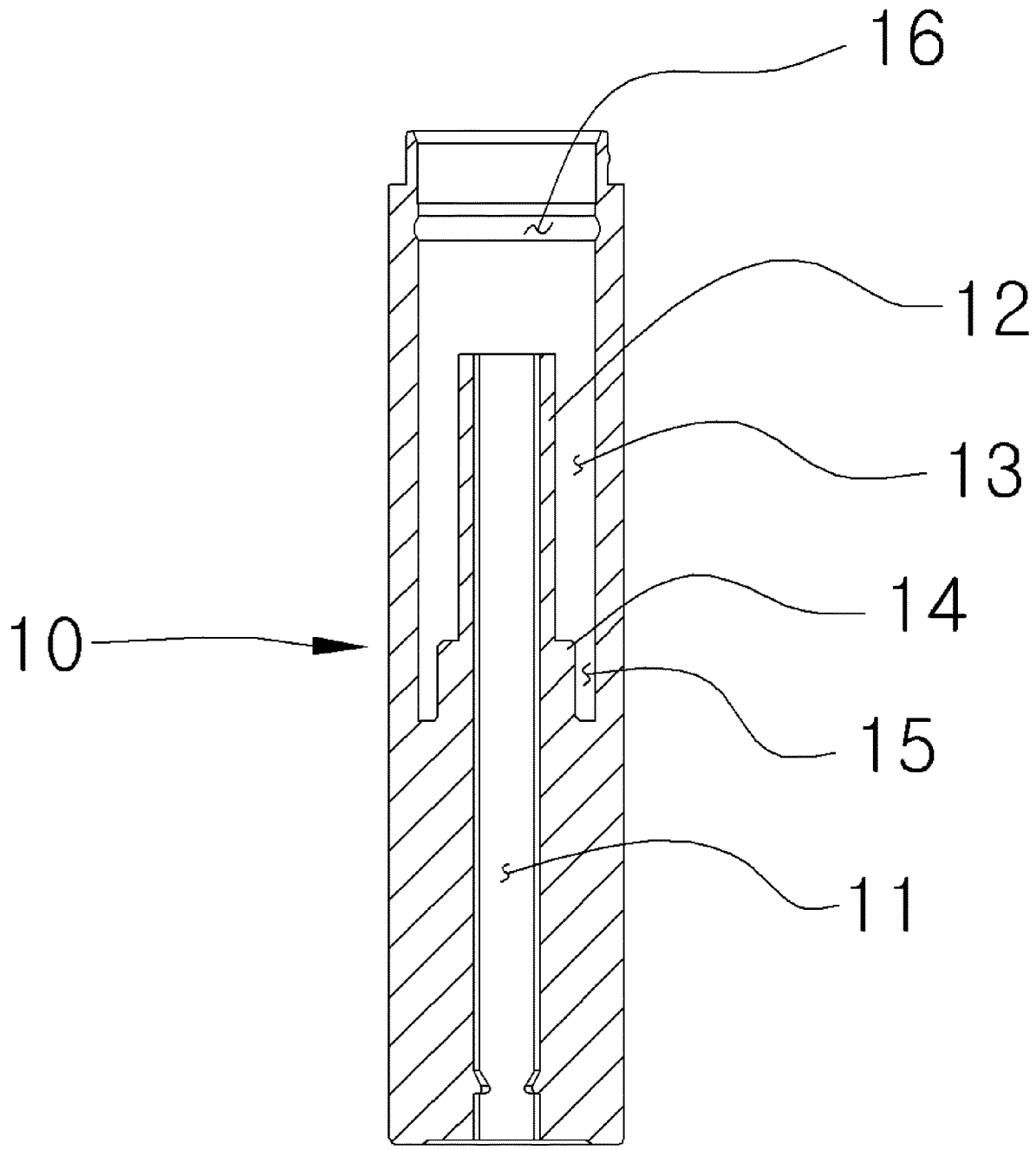
FIG. 4 is a partial sectional view of a lip cosmetic case according to an embodiment of the present invention.
Figure 5:
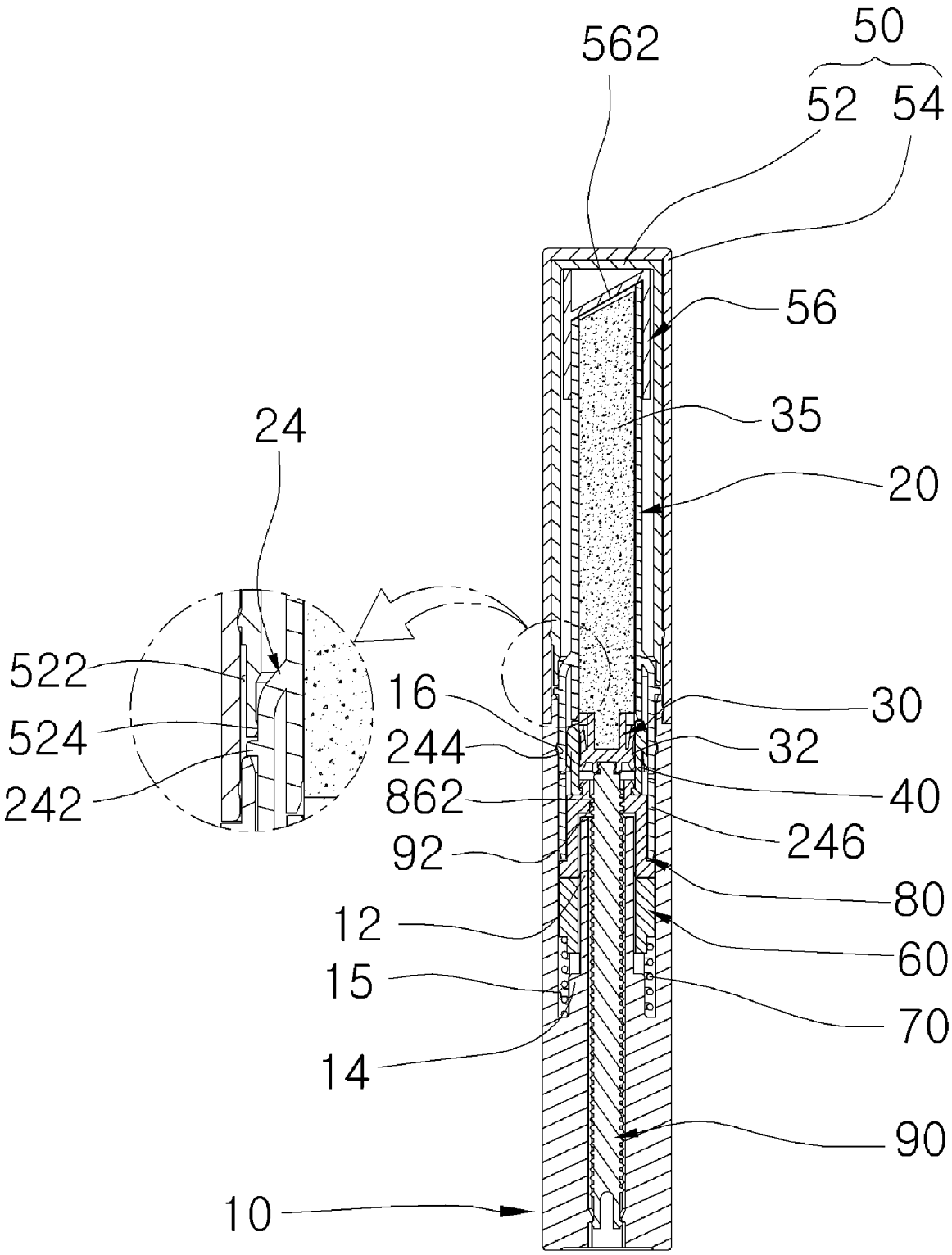
FIG. 5 is a sectional view of a lip cosmetic case according to an embodiment of the present invention.

FIG. 2 is a perspective view of a lip cosmetic case according to an embodiment of the present invention. FIG. 3 is an exploded perspective view of a lip cosmetic case according to an embodiment of the present invention. FIG. 4 is a partial sectional view of a lip cosmetic case according to an embodiment of the present invention. FIG. 5 is a sectional view of a lip cosmetic case according to an embodiment of the present invention.

According to the present invention, the airtight lip cosmetic case having improved sealing capability and having a lip cosmetic product 35, in an upper case 20, rising and protruding when a lower case 10 rotates, includes: the upper case 20 rotatably coupled to an upper portion of the lower case 10; a rising piston 30 coupled inside the upper case 20 to rise and having the lip cosmetic product 35 attached to an upper side thereof; and an over-cap 50 for opening and closing the upper case 20, wherein the over-cap 50 includes an inner over-cap 52 and an outer over-cap 54, and the inner over-cap 52 is formed on a lower outer circumference thereof with an elastic groove 522 such that the lower inner circumference of the inner over-cap 52 is elastically inserted into an outer circumference of the upper case 20.

The lower case 10 has a cylindrical shape with an open top, a lead shaft insertion groove 11 is formed at a center of the lower case 10, and a lead shaft insertion protrusion wheel 12 extends from an outer and upper portion of the lead shaft insertion groove 11.

An operation member installation groove 13 mounted therein with components of the lip cosmetic case according to the present invention is formed between the inner circumference of the lower case 10 and the lead shaft insertion protrusion wheel 12.

As shown in FIG. 4, a plurality of rotation ribs 14 are formed on an outer side of the lead shaft insertion protrusion wheel 12, and an elastic member installation groove 15 is formed in an outer side of the rotation rib 14.

The lower case 10 is formed at an upper inner circumference thereof with a coupling annular groove 16 to which the upper case 20 is coupled.

The upper case 20 is rotatably coupled to the upper portion of the lower case 10.

The upper case 20 guides a vertical movement of the rising piston 30 provided inside the upper case 20.

A sealing shoulder 24 is formed on a lower and outer circumference of the upper case 20, in which the sealing shoulder 24 extends downward from the outer circumference of the upper case 20 while being spaced apart from the outer circumference of the upper case by a predetermined distance.

The upper outer side of the sealing shoulder 24 may be curved to allow the upper outer side of the sealing shoulder 24 to be smoothly inserted into a lower portion of the inner over-cap 52 of the over-cap 50 when the over-cap 50 is coupled to the lower case 10 while covering the upper case 20.

A mount protrusion wheel 242 mounted on an upper end of the lower case 10 protrudes from an outer circumference of the sealing shoulder 24.

A coupling protrusion wheel 244 is formed below the mount protrusion wheel 242 of the sealing shoulder 24 and coupled to the coupling annular groove 16 formed in the inner circumference of the lower case 10.

As shown in FIG. 3, a plurality of second fitting portions 246 are formed on a lower portion of the sealing shoulder 24.

A first operation member 60 is installed in the operation member installation groove 13 of the lower case 10, in which the first operation member 60 is coupled to the lower case 10 so as to be vertically movable, and rotates together with the lower case 10.

First teeth 62 are formed on an upper end of the first operation member 60 in which the first teeth 62 are inclined in one direction only.

A plurality of first fitting portions 64 are formed on a lower portion of the first operation member 60, in which the first fitting portions 64 are inserted between rotation ribs 14 formed inside the lower case 10 so that the first operation member 60 rotates together with the lower case 10 without idling inside the lower case 10 when the lower case 10 rotates.

An elastic member 70 for elastically supporting the first operation member 60 is provided below the first operation member 60, in which the elastic member 70 is inserted into the elastic member installation groove 15 of the lower case 10.

A second operation member 80 is installed on an upper side of the first operation member 60, in which the second operation member 80 is coupled to the upper case 20.

Second teeth 82 are formed on a lower end of the second operation member 80, in which the second teeth 82 are inclined only in one direction to correspond to the first teeth 62 of the first operation member 60 and engaged with the first teeth 62. In other words, when the user grips and fixes the upper case 20 with one hand and rotates the lower case 10 with the other hand, the second operation member 80 is fixed together with the upper case 20, but the first operation member 60 rotates together with the lower case 10, wherein, because the second teeth 82 formed on the lower end of the second operation member 80 and the inclined surfaces of the first teeth 62 formed on the upper end of the first operation member 60 come into contact with each other, and the first operation member 60 is elastically supported by the elastic member 70, the first teeth 62 of the first operation member 60 elastically pass over the second teeth 82 of the second operation member 80, and thus the first operation member 60 rotates only in one direction from the second operation member 80.

A plurality of fitting grooves 84 are formed in an outer circumference of the second operation member 80, in which the second fitting portions 246 of the upper case 20 are inserted thereto. Accordingly, when the lower case 10 rotates, the second operation member 80 is fixed together with the upper case 20 without rotating along the first operation member 60.

A lead shaft through-hole 86 is formed in a center of the second operation member 80, and an operation thread 862 is formed on an outer side of the lead shaft through-hole 86.

A lead shaft 90, which rises while passing through the first operation member 60 and the second operation member 80, is coupled to the inside of the lead shaft insertion protrusion wheel 12 of the lower case 10.

A rising piston 30 is coupled to an upper end of the lead shaft 90, and a lead shaft thread 92 is formed on an outer circumference of the lead shaft 90 and screw-coupled to the operation thread 862 of the second operation member 80.

The rising piston 30 is lifted by the lead shaft 90 in the upper case 20, and the lip cosmetic product 35 is attached onto the rising piston.

A sealing ring 32 is formed on an outer side of the rising piston 30, in which the sealing ring 32 is lifted while coming into tight contact with the inner circumference of the upper case 20.

Accordingly, the lip cosmetic product is prevented from deteriorating or hardening after external air introduced into the lower side of the rising piston 30 through the lower case 10 comes into contact with the lip cosmetic product 35.

A fixed piston 40 is provided on an outer side of the rising piston 30, in which one side of the fixed piston 40 comes into tight contact with a lower end of the upper case 20 and the other side is coupled and fixed to an upper portion of the second operation member 80.

The over-cap 50 is coupled to the lower case 20 while surrounding the upper case 20, so that the upper case 20 is opened and closed.

The over-cap 50 includes an inner over-cap 52 and an outer over-cap 54, in which, as shown in FIG. 5, the inner over-cap 52 is formed on a lower outer circumference thereof with an elastic groove 522 such that the lower inner circumference of the inner over-cap 52 is elastically inserted into an outer circumference of the upper case 20.

In other words, when the over-cap 50 is coupled to the lower case 10, a lower end of the inner over-cap 52 of the over-cap 50 comes into contact with the sealing shoulder 24 of the upper case 20, wherein a space, in other words, an elastic groove 522 is formed on a lower outer circumference of the inner over-cap 52, and the upper outer side of the sealing shoulder 24 is curved, so that the inner over-cap 52 is easily pushed outward to smoothly surround the sealing shoulder 24 of the upper case 20.

Accordingly, when the over-cap 50 is coupled to the lower case 10, the lip cosmetic product can be prevented from deteriorating or hardening after the external air introduced between the lower case 10 and the over-cap 50 comes into contact with the lip cosmetic product 35.

In addition, a sealing protrusion wheel 524 protrudes from an inner circumference of the inner over-cap 52 of the over-cap 50 and comes into tight contact with the outer circumference of the sealing shoulder 24 of the upper case 20.

An inner diameter of the sealing protrusion wheel 524 of the inner over-cap 52 may be smaller than an outer diameter of the sealing shoulder 24, in which, preferably, that the inner diameter of the sealing protrusion wheel 524 of the inner over-cap 52 is smaller than the outer diameter of the sealing shoulder 24 by 0.02 mm to 0.5 mm. In other words, when the inner diameter of the sealing protrusion wheel 524 of the inner over-cap 52 is larger than or equal to the outer diameter of the sealing shoulder 24, because a gap is formed between the sealing protrusion wheel 524 of the inner over-cap 52 and the sealing shoulder 24, or the sealing protrusion wheel 524 of the inner over-cap 52 fails to elastically hold the sealing shoulder 24 of the upper case 20, the sealing capability deteriorates.

An inner cap 56 is further provided on the upper side of the upper case 20 to improve the sealing capability of the lip cosmetic case.

The inner cap 56 is coupled while surrounding an upper portion of the upper case, and an upper end of the inner cap 56 is pressed by the inner over-cap 52 of the over-cap 50 when the over-cap 50 is coupled to the lower case 10.

A blocking plate 562 is formed at an upper inner side of the inner cap 56, in which the blocking plate 562 is inclined in one direction, thereby coming into close contact with the upper end of the upper case 20.

An assembling method of the airtight lip cosmetic case having improved sealing capability configured in the above manner will be described with reference to the accompanying drawings.

To assemble the airtight lip cosmetic case having improved sealing capability according to the present invention, as shown in FIGS. 3 to 5, the elastic member 70 and the first operation member 60 are installed inside the lower case 10, in which the elastic member 70 is inserted into the elastic member installation groove 15 of the lower case 10, and the first fitting portions 64 of the first operation member 60 is inserted between the rotation ribs 14 of the lower case 10.

Next, after the second operation member 80 is screw-coupled to the lead shaft 90, the lead shaft 90 and the second operation member 80 are coupled to the operation member installation groove 13 of the lower case 10, in which the lead shaft 90 is inserted into the lead shaft insertion protrusion wheel 12 of the lower case 10, so that the second teeth 82 of the second operation member 80 are engaged with the first teeth 62 of the first operation member 60.

Next, after the inner cap 56 is coupled to the upper side of the upper case 20, the upper case 20 is turned upside down, contents of the lip cosmetic product 35 are injected from the lower side of the upper case 20, the rising piston 30 is coupled, and the contents of the lip cosmetic product 35 are solidified.

Next, the fixed piston 40 is inserted into the lower case 10 and coupled to the upper portion of the second operation member 80, and the upper case 20 assembled in the above manner is coupled to the upper portion of the lower case 10, in which the coupling protrusion wheel 244 of the upper case 20 is coupled to the coupling annular groove 16 of the lower case 10, and the rising piston 30 is coupled to the upper portion of the lead shaft 90.

Finally, after the over-cap 50 is assembled by coupling the inner over-cap 52 to the inside of the outer over-cap 54, the over-cap 50 is coupled to the upper portion of the lower case 10, so that the assembly of the airtight lip cosmetic case having improved sealing capability according to the present invention is finished.

A method of using the airtight lip cosmetic case having improved sealing capability and assembled in the above manner will be described with reference to the accompanying drawings.

Figure 6:
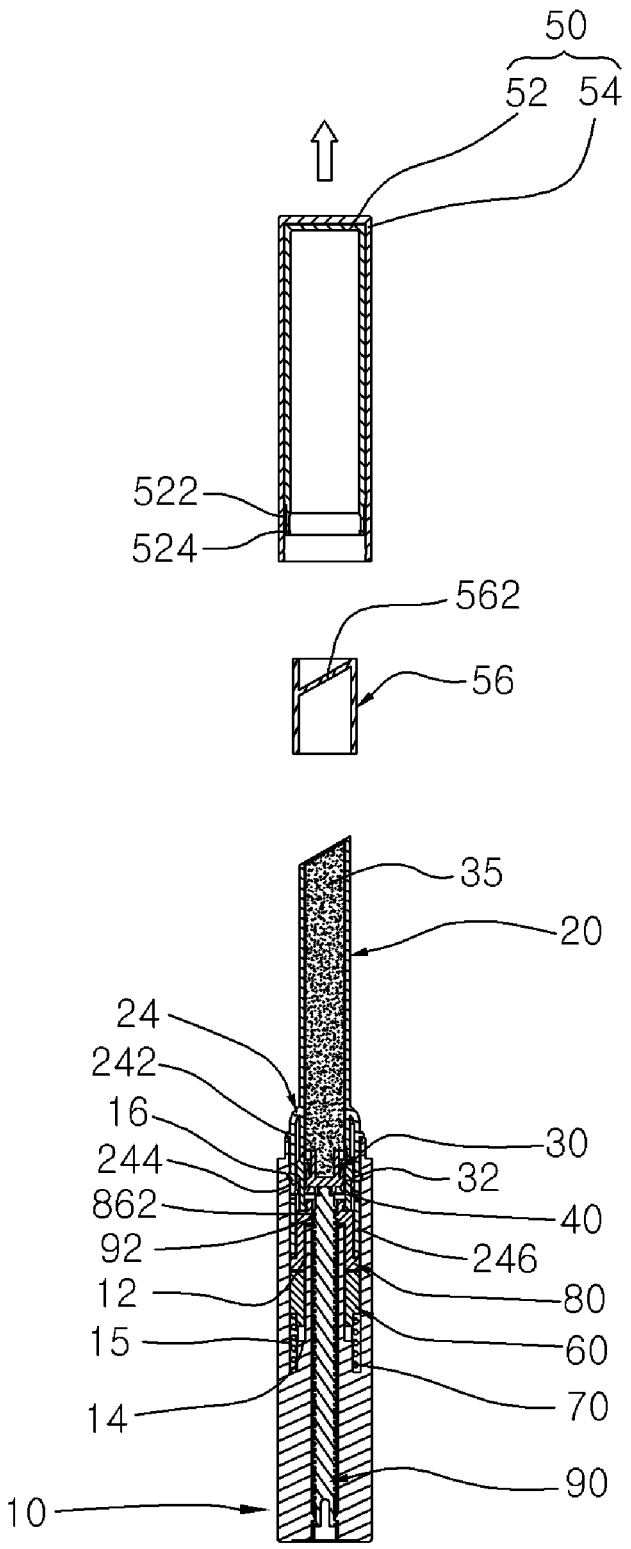
FIG. 6 is a sectional view showing that an over-cap is separated from an inner cap of the lip cosmetic case according to an embodiment of the present invention.
Figure 7:
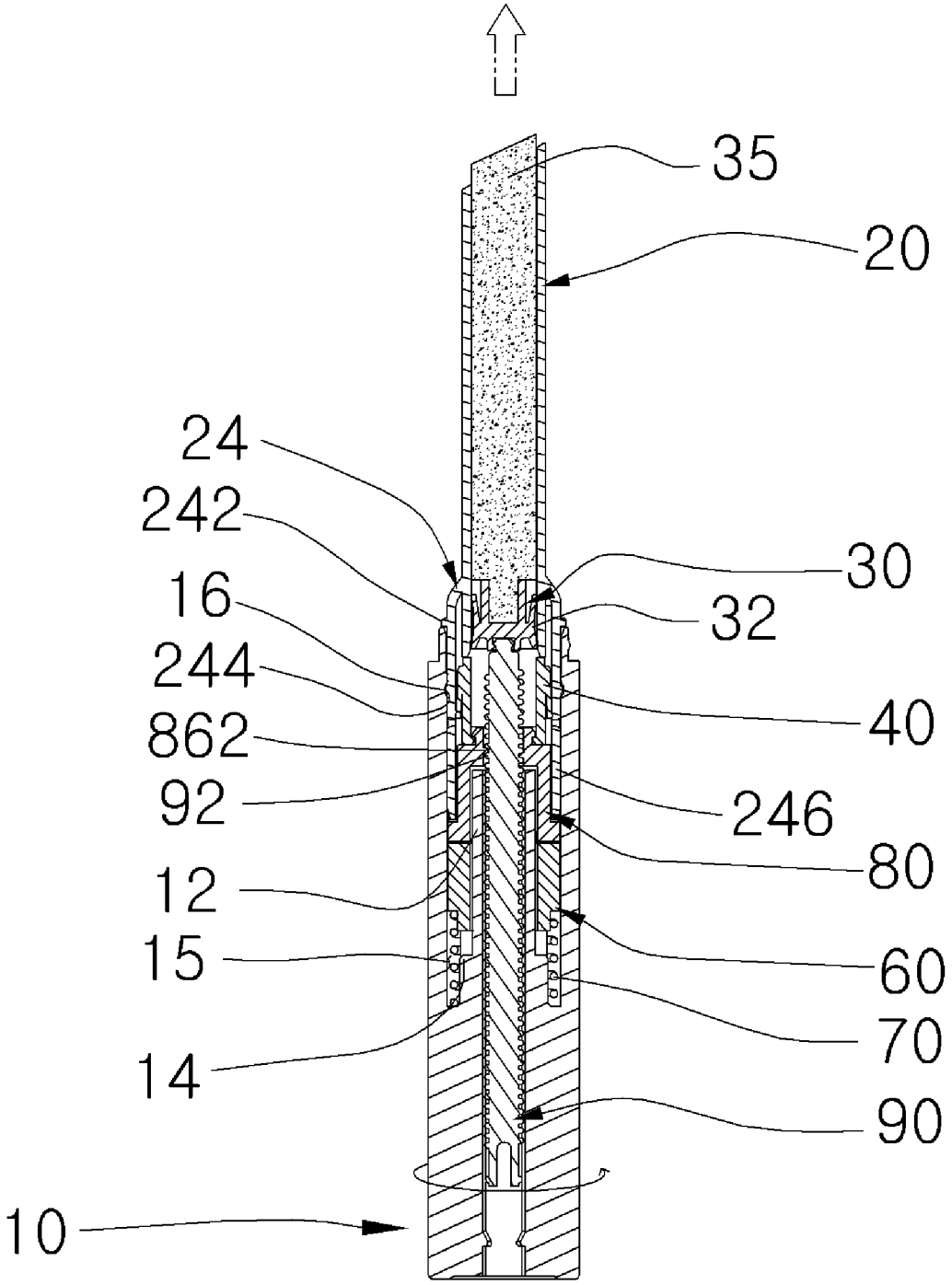
FIG. 7 is a sectional view showing that a lower case of a lip cosmetic case is rotated to eject a lip cosmetic product according to an embodiment of the present invention.
Figure 8:
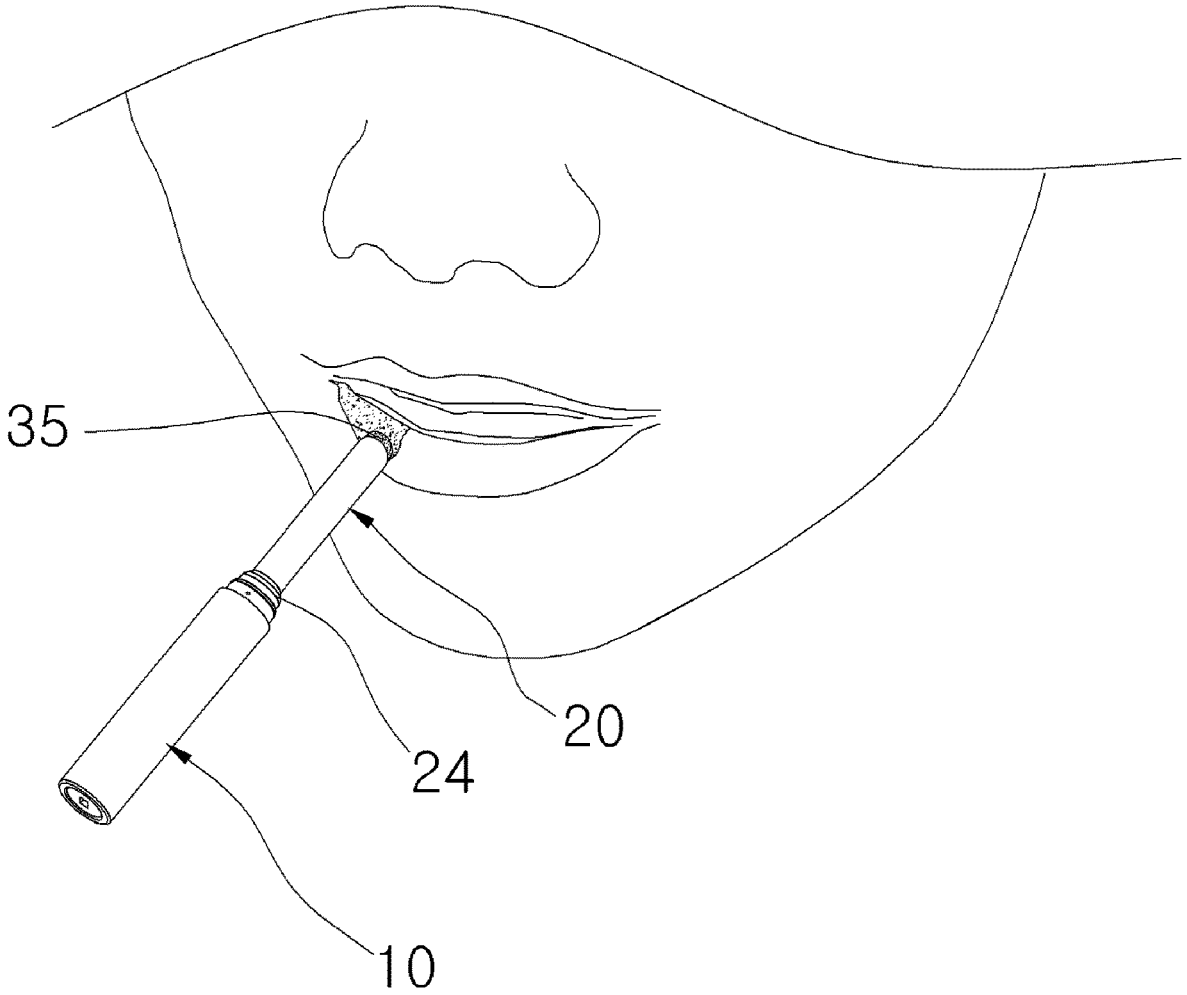
FIG. 8 is a perspective view showing that a user makes up with a lip cosmetic product protruding from a lip cosmetic case according to an embodiment of the present invention.

FIG. 6 is a sectional view showing that an over-cap is separated from an inner cap of the lip cosmetic case according to an embodiment of the present invention. FIG. 7 is a sectional view showing that a lower case of a lip cosmetic case is rotated to eject a lip cosmetic product according to an embodiment of the present invention. FIG. 8 is a perspective view showing that a user makes up with a lip cosmetic product protruding from a lip cosmetic case according to an embodiment of the present invention.

To use the airtight lip cosmetic case having improved sealing capability according to the present invention, first, as shown in FIG. 6, the over-cap 50 and the inner cap 56 are sequentially separated from the lower case 10.

Then, as shown in FIG. 7, when the upper case 20 is held and fixed by one hand and the lower case 10 is rotated by the other hand, the second operation member 80 is fixed together with the upper case 20, but the first operation member 60 rotates together with the lower case 10.

At this time, because the second teeth 82 formed on the lower end of the second operation member 80 and the inclined surfaces of the first teeth 62 formed on the upper end of the first operation member 60 come into contact with each other, and the first operation member 60 is elastically supported by the elastic member 70, the first teeth 62 of the first operation member 60 elastically pass over the second teeth 82 of the second operation member 80, and thus the first operation member 60 rotates with respect to the second operation member 80.

When the lower case 10 and the first operation member 60 rotate, the lead shaft 90 provided inside the lower case 10 also rotates together, in which the lead shaft 90 is screw-coupled to the second operation member 80 fixed to the upper case 20 so that the lead shaft 90 gradually rises while rotating.

Accordingly, the rising piston 30 coupled to the upper portion of the lead shaft 90 rises while coming into tight contact with the inner circumference of the upper case 20, and the lip cosmetic product 35 attached to the upper portion of the rising piston 30 also rises, so that an upper portion of the lip cosmetic product 35 is exposed to the upper side of the upper case 20.

Then, as shown in FIG. 8, the lip make-up is performed using the lip cosmetic product 35 exposed to the outside.

After the make-up is completed, the inner cap 56 and the over-cap 50 are coupled to the lower case 10 to store or carry the lip cosmetic case.

When the over-cap 50 is coupled to the lower case 10 while covering the upper case 20, a lower end of the inner over-cap 52 of the over-cap 50 comes into contact with the sealing shoulder 24 of the upper case 20. At this time, a space, in other words, an elastic groove 522 is formed on a lower outer circumference of the inner over-cap 52, and the upper outer side of the sealing shoulder 24 is curved, so that the inner over-cap 52 is easily pushed outward to smoothly surround the sealing shoulder 24 of the upper case 20.

Accordingly, the lip cosmetic product can be prevented from deteriorating or hardening after the external air introduced between the lower case 10 and the over-cap 50 comes into contact with the lip cosmetic product 35.

Herein, the description of the present invention is merely one embodiment for carrying out the airtight lip cosmetic case having improved sealing capability, and the present invention is not limited to the embodiment. It will be apparent to those skilled in the art in that various different substitutions, deformations and modifications are available within the scope without departing from the invention.

| Description of Reference Numerals | |
|---|---|
| 10: lower case | 20: upper case |
| 24: sealing shoulder | 30: rising piston |
| 32: sealing ring | 35: lip cosmetic product |
| 40: fixed piston | 50: over-cap |
| 52: inner over-cap | 54: outer over-cap |
| 60: first operation member | 70: elastic member |
| 80: second operation member | 90: lead shaft |
| 522: elastic groove | 524: sealing protrusion wheel |

The invention claimed is:

1. An airtight lip cosmetic case having improved sealing capability in which a lip cosmetic product inside an upper case rises and protrudes when a lower case rotates, the airtight lip cosmetic case comprising:

the upper case rotatably coupled to an upper portion of the lower case;

a rising piston coupled inside the upper case to rise and having the lip cosmetic product attached to an upper side of the rising piston; and an over-cap for opening and closing the upper case, wherein the over-cap includes an inner over-cap and an outer over-cap, and the inner over-cap is formed on a lower outer circumference thereof with an elastic groove such that, when the over-cap is coupled to the lower case, a lower inner circumference of the inner over-cap elastically contacts and surrounds a lower outer circumference of the upper case.

2. The airtight lip cosmetic case of claim 1, wherein a sealing shoulder is formed on the lower outer circumference of the upper case, in which the sealing shoulder extends downward from the outer circumference of the upper case while being spaced apart from the outer circumference of the upper case by a predetermined distance.

3. The airtight lip cosmetic case of claim 2, wherein an upper outer portion of the sealing shoulder has a curved shape.

4. The airtight lip cosmetic case of claim 1, wherein the upper case is provided on an upper side thereof with an inner cap, in which the inner cap is coupled to the upper case while surrounding an upper portion of the upper case.

5. The airtight lip cosmetic case of claim 1, wherein the rising piston is provided on an outer side thereof with a sealing ring so that the rising piston rises in a state in which the sealing ring comes into tight contact with an inner circumference of the upper case.

6. The airtight lip cosmetic case of claim 1, wherein a sealing protrusion wheel protrudes from an inner circumference of the inner over-cap of the over-cap to come into tight contact with the outer circumference of the upper case.

7. The airtight lip cosmetic case of claim 6, wherein:

the upper case includes a sealing shoulder and an inner diameter of the sealing protrusion wheel of the inner over-cap is smaller than an outer diameter of the sealing shoulder of the upper case.

* * * * *